US008230600B2

(12) United States Patent
Hart et al.

(10) Patent No.: US 8,230,600 B2
(45) Date of Patent: Jul. 31, 2012

(54) CARTRIDGE DETACHMENT SENSOR

(75) Inventors: Robert Anthony Hart, Bracknell (GB); Matthias Gester, Farnborough (GB); Hannah Bryony Mantle, Fleet (GB)

(73) Assignee: The Gillette Company, Boston, MA (US)

( * ) Notice: Subject to any disclaimer, the term of this patent is extended or adjusted under 35 U.S.C. 154(b) by 200 days.

(21) Appl. No.: 12/208,544

(22) Filed: Sep. 11, 2008

(65) Prior Publication Data

US 2009/0071008 A1 Mar. 19, 2009

Related U.S. Application Data

(60) Provisional application No. 60/994,075, filed on Sep. 17, 2007.

(51) Int. Cl.
*B26B 21/40* (2006.01)

(52) U.S. Cl. ..... 30/41.7; 30/34.05; 30/526

(58) Field of Classification Search ..... 30/526, 30/527, 32, 42–45, 41.7; 338/47
See application file for complete search history.

(56) References Cited

U.S. PATENT DOCUMENTS

| | | | | |
|---|---|---|---|---|
| 4,924,995 | A | 5/1990 | Adrian et al. | |
| 5,347,715 | A * | 9/1994 | Friedland | 30/41.7 |
| 6,009,623 | A | 1/2000 | Orloff | |
| 6,275,137 | B1 * | 8/2001 | Doppalapudi et al. | 338/2 |
| 6,460,251 | B1 | 10/2002 | Orloff | |
| 6,708,408 | B2 | 3/2004 | Orloff | |
| 6,944,952 | B1 | 9/2005 | Tseng | |
| 7,069,658 | B2 | 7/2006 | Tseng | |
| 7,100,283 | B1 | 9/2006 | Grdodian et al. | |
| 7,145,432 | B2 | 12/2006 | Lussey et al. | |
| 7,703,333 | B2 * | 4/2010 | Hayakawa et al. | 73/849 |
| 2004/0140045 | A1 | 7/2004 | Burgess et al. | |
| 2005/0110766 | A1 | 5/2005 | Kent et al. | |
| 2005/0122065 | A1 | 6/2005 | Young | |
| 2006/0022614 | A1 | 2/2006 | Young | |
| 2006/0026841 | A1 | 2/2006 | Freund | |
| 2006/0032055 | A1 | 2/2006 | Simms et al. | |
| 2006/0066085 | A1 | 3/2006 | DuRocher | |
| 2008/0172878 | A1 | 7/2008 | Luxton | |

FOREIGN PATENT DOCUMENTS

| | | |
|---|---|---|
| WO | WO 98/33193 | 7/1998 |
| WO | WO 99/38173 | 7/1999 |
| WO | WO 00/79546 | 12/2000 |
| WO | WO 2005/029514 | 3/2005 |
| WO | WO 2006/064111 | 6/2006 |

* cited by examiner

*Primary Examiner* — Sean Michalski
(74) *Attorney, Agent, or Firm* — Jay A. Krebs

(57) ABSTRACT

A safety razor has a handle and a cartridge selectively detachable from the handle. The cartridge has at least one blade with a sharp cutting edge and an expected shaving utility. A connecting structure is coupled to the handle and attaches or detaches the cartridge from the handle in response to a detachment action performed by a user. A detector within the handle has an actuator coupled to the connecting structure and a sensor for generating a signal, wherein the actuator applies an action on the sensor during the action and the sensor generates the signal in response to the action.

15 Claims, 12 Drawing Sheets

CARTRIDGE DETACHMENT SENSOR

CROSS REFERENCE TO RELATED APPLICATIONS

This application claims priority under 35 U.S.C. §119(e) from U.S. Provisional Patent Application Ser. No. 60/994,075, filed Sep. 17, 2007.

BACKGROUND

This invention relates to safety razors for wet shaving and, more specifically, to powered wet shaving systems with disposable blade cartridges.

Some wet shaving razors have been provided with battery-powered devices such as motors for vibrating a shaving cartridge. One such vibrating wet shaving razor is that sold by The Gillette Company under the trade name the Gillette Fusion™ razor. This razor features a battery disposed in a chamber within its handle, and a motor coupled to the distal tip, on which is mounted a replaceable cartridge, and electronic controls for razor operation.

Some wet shaving razors attempt to track blade wear and indicate when the cartridge should be replaced. In the course of shaving hundreds of hairs on a daily basis, the blades of a shaving cartridge inevitably grow duller. This dullness is difficult to detect by visual inspection. In too many cases, by the time a user realizes that a blade is too dull to use, he has already begun what will be an unpleasant shaving experience.

Some wet shaving razors have mechanical shave counters for manual counting of each shave. Other wet shaving razors have electronic shave counters that track shaving action (e.g., exposing the razor to moisture, contacting skin with blades, moving or applying forces on the blades or cartridge, gripping the handle, activating a vibration source) as a proxy for blade wear. Some electronic shave counters count discrete shaving uses (e.g., activation of a vibration source) while others count time that the razor is active (e.g., vibrating) or the time that the razor spends shaving (e.g., detecting skin contact or cartridge movement). Some wet shaving razors estimate a remaining cartridge life based on the tracked shaving use.

Some wet shaving razors have an indicator to inform a user that the cartridge should be replaced. Some indicators are numeric displays, either mechanical or electronic, showing a count of accumulated shaving uses. The user must learn by experience what number of shaves to expect from a cartridge and must remember to change the cartridge at that number of shaves. Some indicators abruptly inform the user that the cartridge should be replaced, such as by changing vibration (e.g., changing vibration frequency, vibrating in a pattern), emitting an audible sound, or activating a light source, without a warning that the suggested replacement is approaching.

One wet shaving razor includes an indicator having a series of seven LEDs. When the razor senses that a cartridge has been attached, the entire series is lit to indicate the cartridge has all of a predetermined initial shaving time remaining. As the razor is used, the initial shaving time is counted down and LEDs are extinguished in proportional sharp steps. When all the LEDs are extinguished, no shaving time remains and the cartridge should be replaced. Indicators with more LEDs tend to consume more power and cost more than indicators with fewer LEDs.

Mixing colors of light, also called additive color mixing, is known. Some applications of additive color mixing, such as signs, ornamental displays, and decorative lighting, for example, mix light of two or more LEDs to create light colors different than either LED.

Using materials that change electrical properties in response to a change in applied forces in switches are known.

A need exists to overcome the shortcomings aforementioned.

SUMMARY

In one aspect, the invention features a safety razor having a handle and a cartridge selectively detachable from the handle. The cartridge has at least one blade with a sharp cutting edge and an expected shaving utility. A connecting structure is coupled to the handle and attaches or detaches the cartridge from the handle in response to an action performed by a user. A detector within the handle has an actuator coupled to the connecting structure and a sensor for generating a signal, wherein the actuator applies an action on the sensor during the action and the sensor generates the signal in response to the action.

Certain implementations of the invention may include one or more of the following features. The sensor may be conductive, capacitive, magnetic, resistive, proximity, pressure sensitive, chemical, inductive, electrical, mechanical, electromechanical, electromagnetic, and combinations thereof. The sensor is convertible between a first level and second level in response to the action.

The sensor has a resistive member comprising a polymer and particles of metal or semi-conducting material. The resistive member has a first level of conductance when quiescent and a second level of conductance when the action is applied by the actuator. The sensor has first and second electrodes each electrically coupled to the resistive member. The resistive member is configured to electrically couple the first and second electrodes when having the second level of conductance and to electrically uncouple the first and second electrodes when having the first level of conductance. The sensor includes a pressure sensitive resistor for generating the signal in proportion to the pressure applied by the actuator.

The razor has an electrical arrangement for detecting and tracking utility of the razor and determining a remaining shaving utility of the cartridge based on an expected utility and a tracked utility. The electrical arrangement receives the signal and resets the tracked utility when the signal exceeds a threshold value. The sensor includes a microswitch. The connecting structure has a button and the action includes pushing the button through a detachment stroke. The actuator includes a beam member projecting from the button transversely to an axis of the of the detachment stroke.

The razor has an electrical arrangement for detecting and tracking utility of the razor, determining a remaining shaving utility based on the beginning shaving utility and the tracked utility, and resetting the tracked utility in response to the signal. Resetting the tracked utility includes attaching or detaching the cartridge with the connecting structure. The electrical arrangement has an input source.

The input source detects user activation of an electrical device. The electrical arrangement detects the blade unit contacting a shaving surface. The electrical arrangement tracks a number of contacts between the cartridge and the shaving surface. The electrical arrangement tracks an accumulating time period that the cartridge contacts the shaving surface.

The electrical arrangement detects pivotal displacement of the cartridge from a rest position. The electrical arrangement tracks a number of pivotal displacements from the rest position. The electrical arrangement tracks an accumulating time period of pivotal displacement from the rest position. The electrical arrangement detects force acting on the cartridge. The electrical arrangement compares the detected force to a threshold value and tracks a number of occurrences that the detected force exceeds the threshold value. The electrical arrangement compares the detected force to a threshold value and tracks an accumulating time period that the detected force exceeds the threshold value. The electrical arrangement is reset by attaching/detaching the cartridge to/from the connecting structure or by continually depressing the power switch for at least 1 second.

Other features and advantages of the invention will be apparent from the description and drawings, and from the claims.

DETAILED DESCRIPTION

Razor Structure

Figure 1:
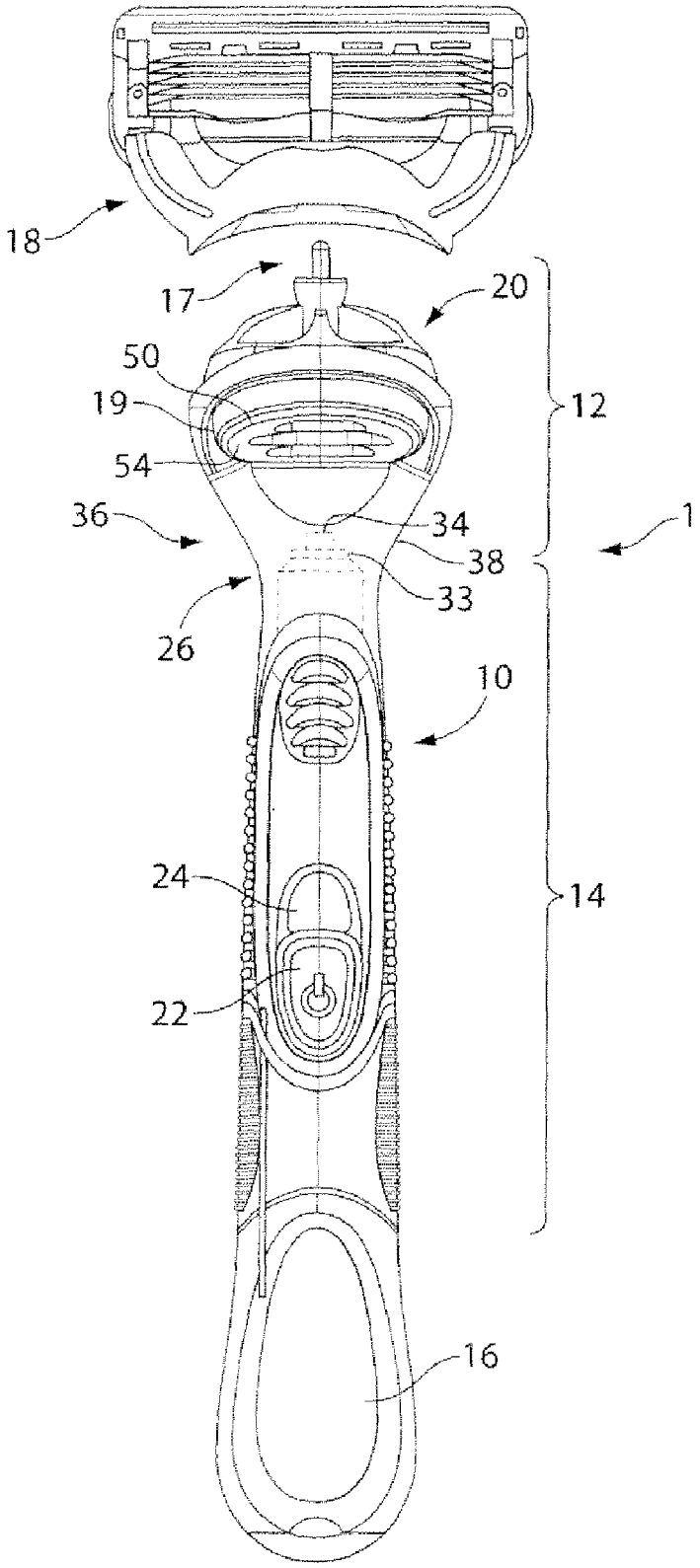
FIG. 1 is a top view of a razor according to one embodiment of the present invention, with the cartridge separated from the handle.
Figure 1A:
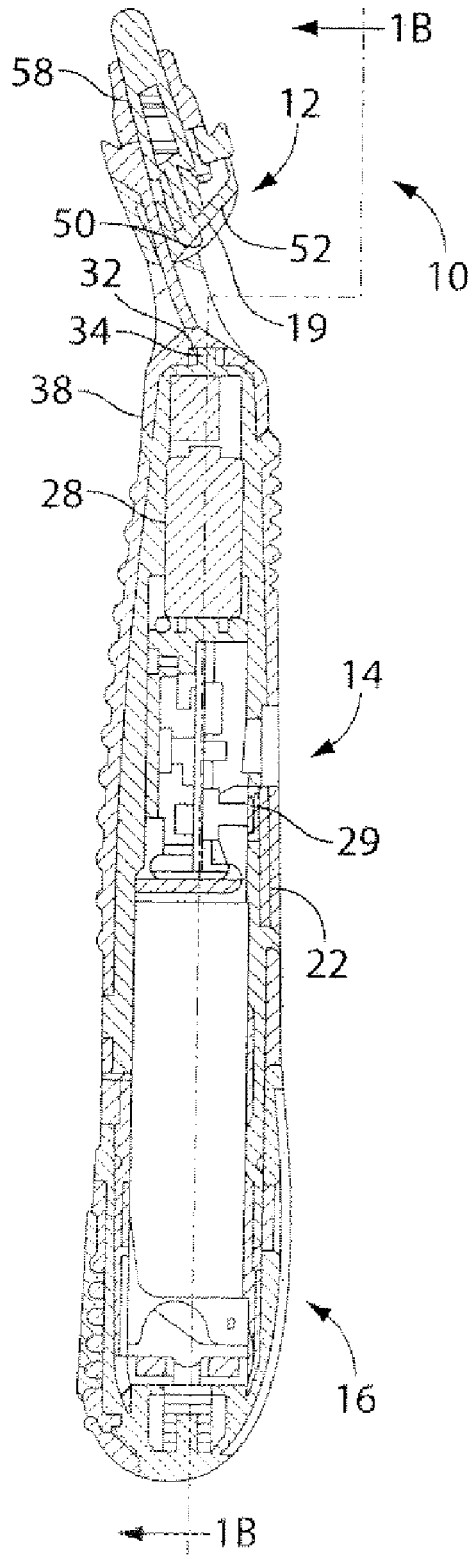
FIGS. 1A and 1B are cross sectional views of the razor handle of FIG. 1.
Figure 1B:
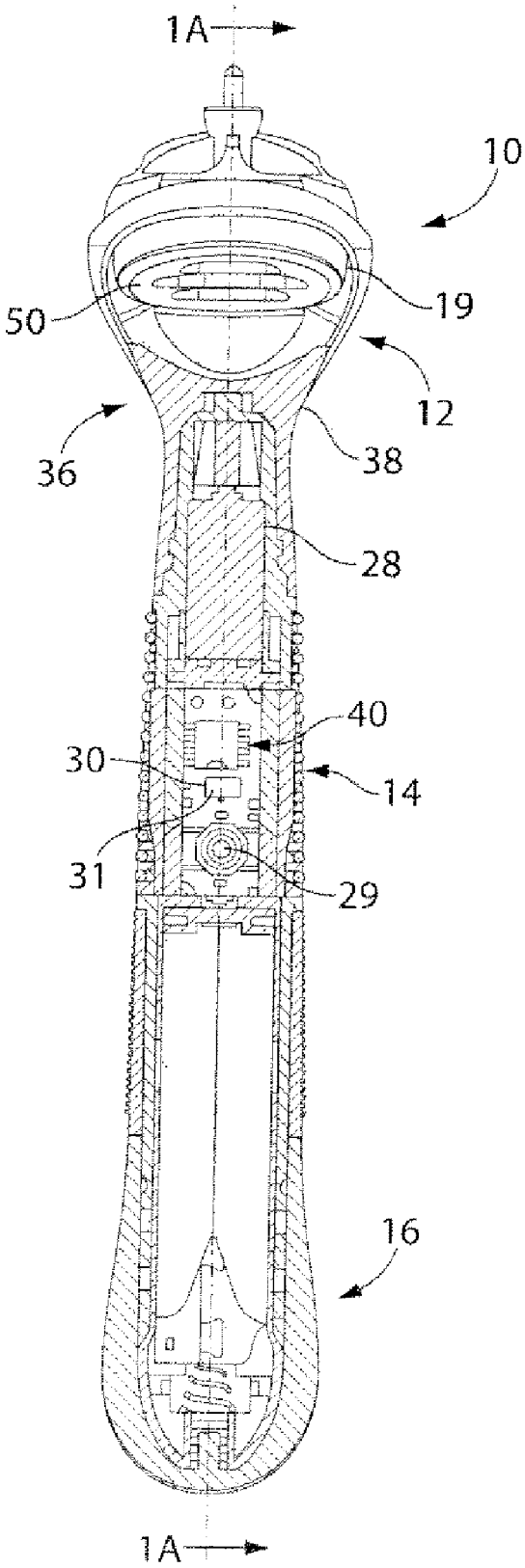

Referring to FIGS. 1, 1A, and 1B, a razor 1 has a cartridge 18 and a handle 10 that includes a razor head 12, a grip tube 14, and a battery shell 16. Razor head 12 includes a connecting structure 17 for connecting cartridge 18 to handle 10 and a release mechanism 19 for releasing cartridge 18 from connecting structure 11. The grip tube 14 is constructed to be held by a user during shaving, and to contain the components of the razor that provide the battery-powered functionality (electrical arrangement) of the razor, e.g., an electrical device 28, a printed circuit board ("PCB") 30, an electronic switch 29 and the light 31 mounted on the printed circuit board. The electrical device 28 may be a motor, a vibration generator, a heat source, a pump, a radiation generator, a magnetic field generator, an electrical field generator, an electromagnetic field generator, chemical source, or combinations thereof may be substituted for vibration electrical device 28.

The grip tube 14 includes an actuator button 22 that may be pressed by the user to actuate the battery-powered functionality of the razor via an electronic switch 29. In some examples, the grip tube may also include a transparent window 24 to allow the user to view a light 31 or display or other visual indicator, e.g., an LED or LCD, which provides a visual indication to the user of battery status and/or other information. As described so far, razor handle 10 is known and described in further detail in U.S. application Ser. No. 11/220,015, filed on Apr. 10, 2005, published as U.S. Pat. App. Pub. No. 2007/0050981. The razor may be powered by various energy sources, including but not limited to, radiant, kinetic, potential, thermal, magnetic, gravitational, sound energy, light energy, electromagnetic, chemical, and combinations thereof.

Figure 2:
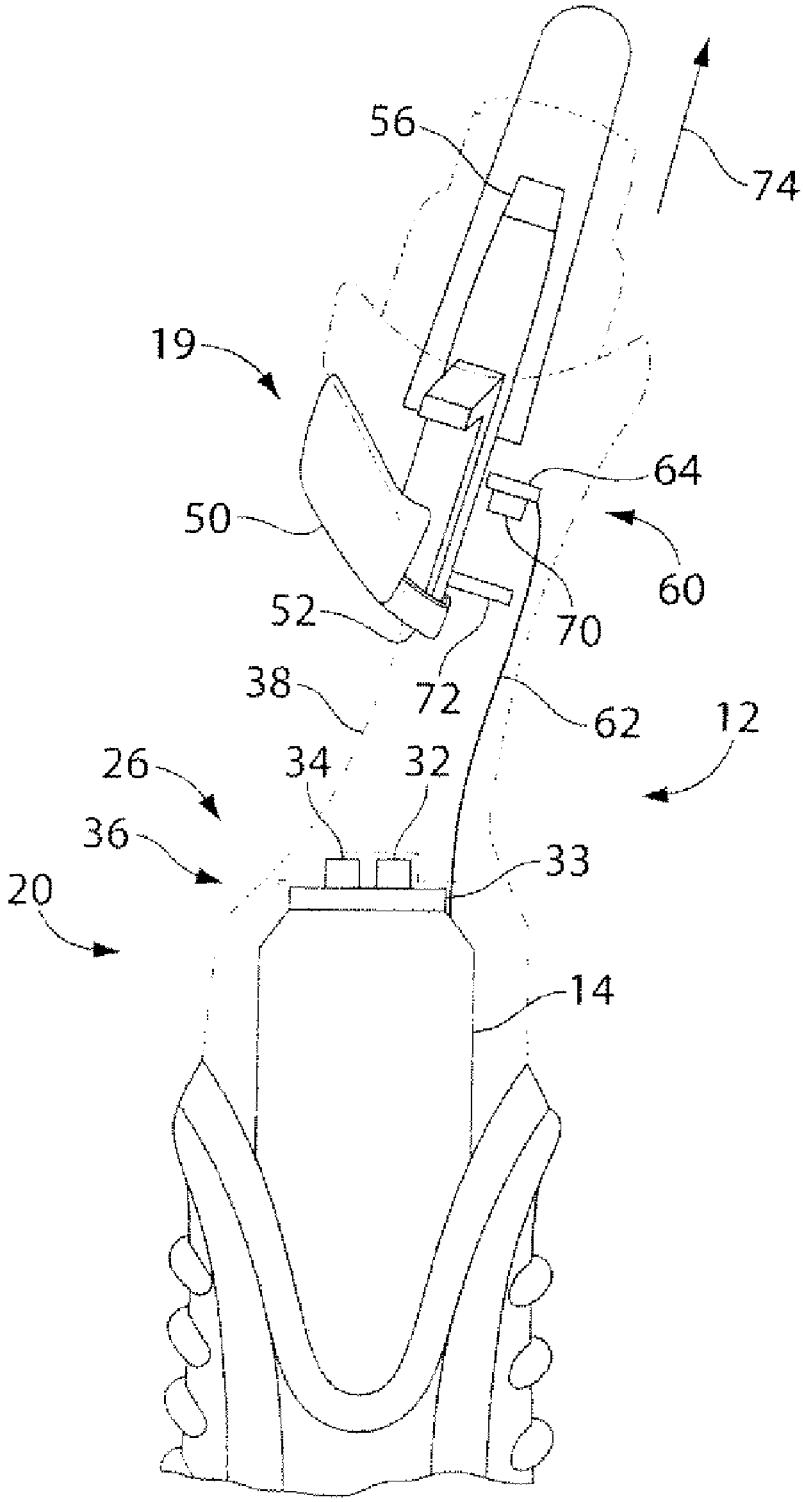
FIG. 2 is a partial side view of the razor handle of FIG. 1 showing components therein.

Referring to FIGS. 1, 1A, and 2, an indicator 26 is disposed toward forward end 20 of grip tube 14 and includes, in some examples, LEDs 32 and 34 electrically coupled to a controller 40 through PCB 33. In other embodiments, the indicator is located any place on or within the razor. Other indicators, e.g., visual, audible, olfactory, sensory, or tactile, can be used. While indicator 26 may include two different colored light sources, three or more light sources could be used. In one example, LED 32 emits blue light and LED 34 emits white light, though any suitable two colors could be used.

Indicator 26 further includes a light mixing member 36 enclosing LEDs 32 and 34. When both LEDs 32 and 34 emit lights of different colors to indicate the remaining shaving utility of cartridge 18, member 36 mixes the two colors and appears to signal one color, as described in more detail below. In an example, light mixing member 36 is transparent neck portion 38 extending around the circumference of grip tube 14 and completely enclosing end 20. In other examples, light mixing member 36 could be any portion of handle 10 or cartridge 18 configured to mix light from LEDs 32 and 34 such as a window, lens, light pipe, or some combination thereof, in neck portion 38, grip tube 14, or cartridge 18. Neck portion 38 preferably is molded from a clear Zylar acrylic co-polymer, available from Nova Chemicals Corp., Moon Township, Pa., but could be formed from any suitable clear or translucent material.

Razor head 12 includes a release mechanism 19 including button 50 having a base member 52 with forwardly projecting pusher arms 56 for releasing cartridge 18 from connecting structure 17. A gripping member 54 is disposed on the base member 52 for pushing engagement when releasing cartridge 18. As described so far, cartridge release mechanism is known and described in further detail in U.S. Pat. No. 7,197,825.

Cartridge Detachment Sensor

Figure 4:
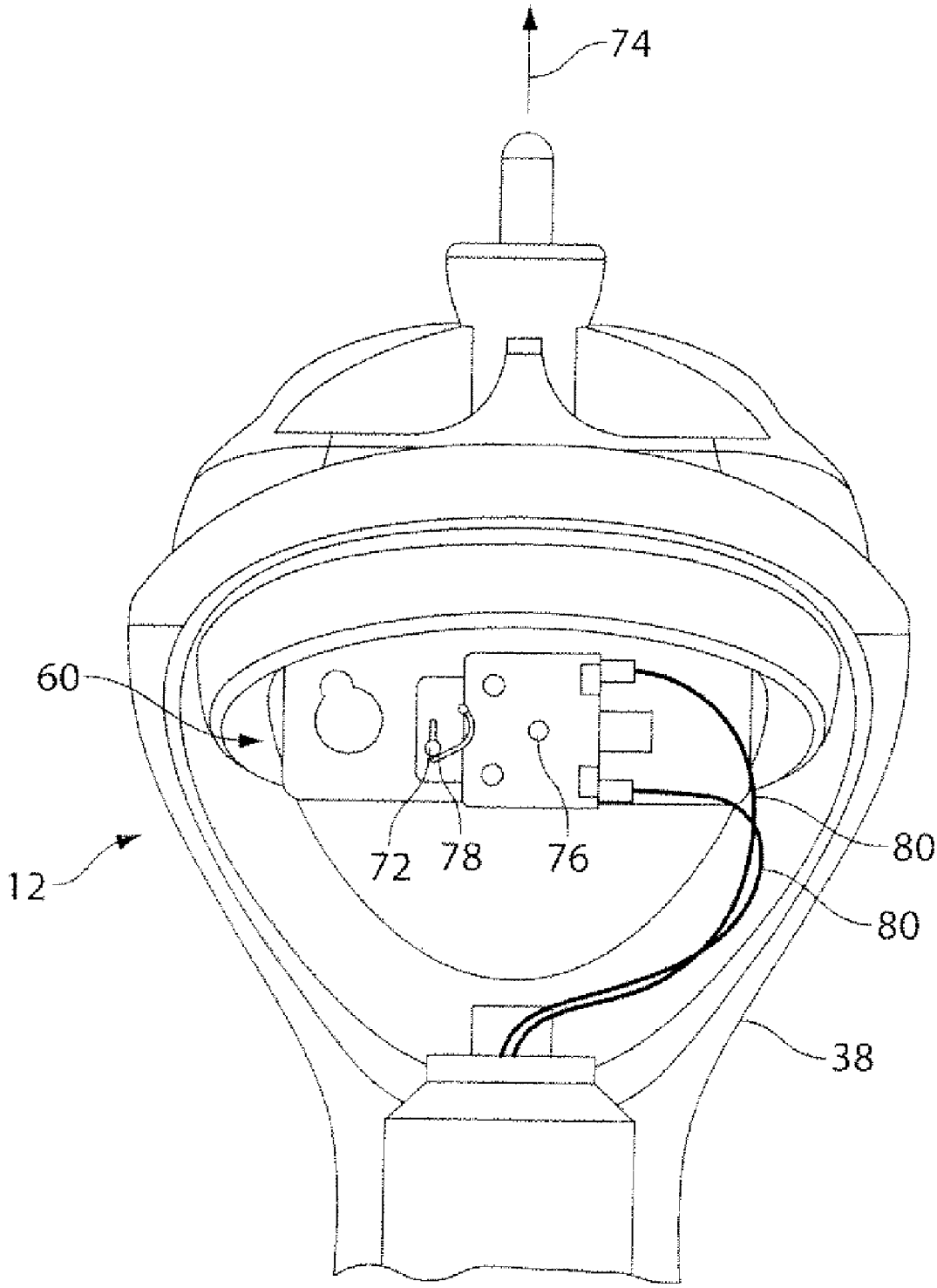
FIG. 4 is a partial bottom view of a razor head of FIG. 1.

In some examples, the razor head 12 includes a sensor 60 electrically coupled to controller 40 through lines 62 for sensing when the cartridge 18 is attached to or detached from razor head 12. Referring to FIGS. 1, 2 and 4, in one example, sensor 60 may include a microswitch 76 disposed in razor head 12 and a pin member 72 projecting from button 50 transversely to forward direction 74. Microswitch 76 may be a normally closed or normally open switch having a forwardly biased toggle member 78 and is electrically coupled to controller 40 by lines 80. When button 50 is in a rearward position, pin member 72 urges toggle member 78 rearwardly and maintains microswitch 76 in an "cartridge attached" state (e.g., closed for a normally closed microswitch). When the button 50 is pushed forwardly in direction 74 to detach the cartridge 18, the forward bias of the toggle member 78 changes the state of microswitch 76 to a "cartridge detached" state (e.g., open for a normally closed microswitch). Alternatively, microswitch 76 may have a rearwardly biased toggle member 78 that is urged forwardly by pin member 72 to change switch from "cartridge attached" to "cartridge detached" state.

Figure 3:
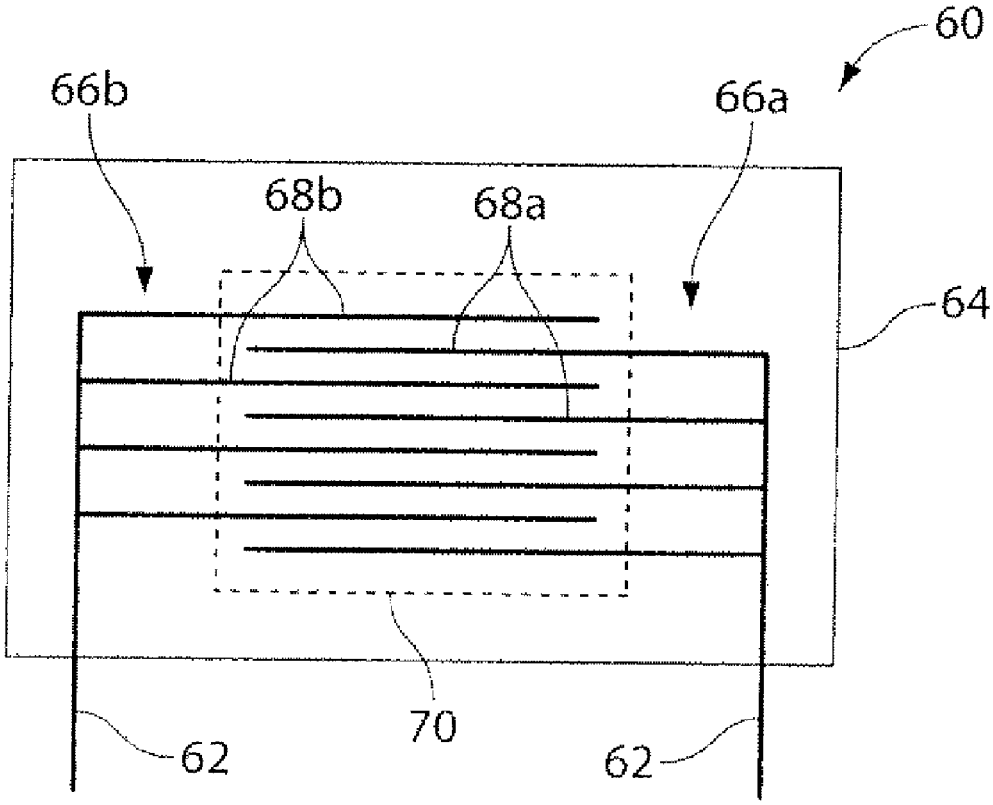
FIG. 3 is a circuit diagram for a cartridge detachment sensor.

Referring to FIGS. 2 and 3, in other examples, sensor 60 may include a PCB 64 mounted in razor head 12 and having electrodes 66*a* and 66*b* thereon. As best seen in FIG. 3, fingers 68*a* of electrode 66*a* are interlaced with but are not electrically coupled with fingers 68*b* of electrode 66*b*. Resistive member 70 electrically contacts but generally does not electrically couple electrode fingers 68*a* and 68*b*. In some examples, resistive member 70 may be formed of a quantum tunneling composite (QTC) of finely dispersed conductive metallic particles, such as metallic alloy or reduced metal oxide particles, in a non-conductive matrix material, such as an elastomer. In QTCs, the metal particles are dispersed closely to each other but do not make contact to form direct conductive paths through the composite while in a quiescent state. When under pressure, however, the particles move close enough together that highly conductive paths form from quantum tunneling between the conductive particles. When the pressure is removed, the QTC returns to its non-conductive quiescent state. In one example, resistive member may be an about 4 mm by about 2 mm portion of QTC pills available from PeraTech Ltd. North Yorkshire, England. As the button 50 is pushed forward to release cartridge 18, pin member 72 applies pressure to resistive member 70 changing its state from non-conductive to conductive and electrically coupling electrodes 66*a* and 66*b*. Consequently, the change in voltage across electrodes 66*a* and 66*b* may be detected by controller 40.

In other examples, resistive member 70 may be formed from a pressure sensitive polymer having conductive (e.g., carbon) or semi-conductive (e.g., silicon) particles dispersed therein. Generally, a pressure sensitive polymer would electrically couple electrodes 66*a* and 66*b* and has a base resistance while in a quiescent state and increase or decrease resistance as a function of pressure applied thereto. In other examples, the resistive member 70 is made of a polymer, metallic particles, a semi-conductive material, combinations thereof, or other materials suitable for the intended purpose.

Figure 5:
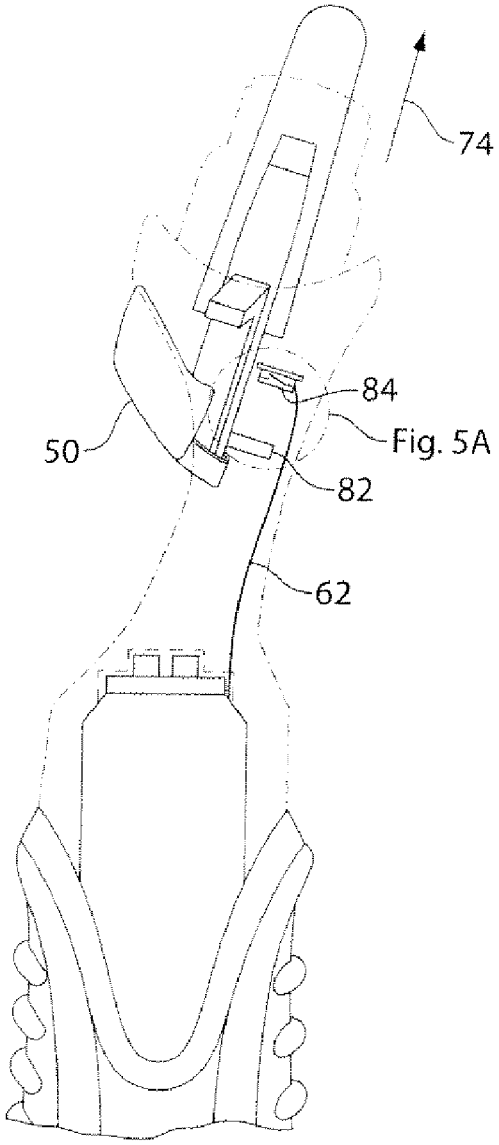
FIGS. 5 and 5A are partial side views of the razor handle of FIG. 1 showing components therein.
Figure 5A:
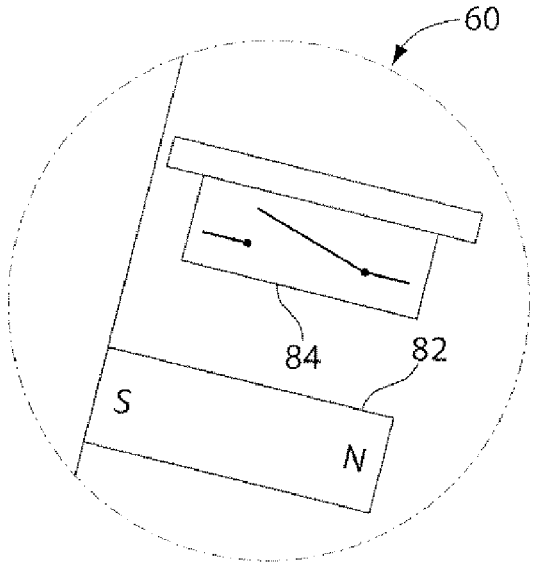

Referring to FIGS. 5 and 5A in still other examples, sensor 60 may include a magnetic member 82 disposed on button 50 and reed switch 84 electrically coupled to controller 40 in a "cartridge attached" state (e.g., closed) (FIG. 5). As the button 50 is pushed forwardly along direction 74 to release cartridge 18, the magnetic field of member 82 changes reed switch 84 to a "cartridge detached" state (e.g., open) (FIG. 5A). When button 50 is released and moves rearwardly, reed switch 84 returns to a "cartridge attached" state. Other switches can be used in place of reed switch 84, e.g. a Hall effect switch.

Figure 6:
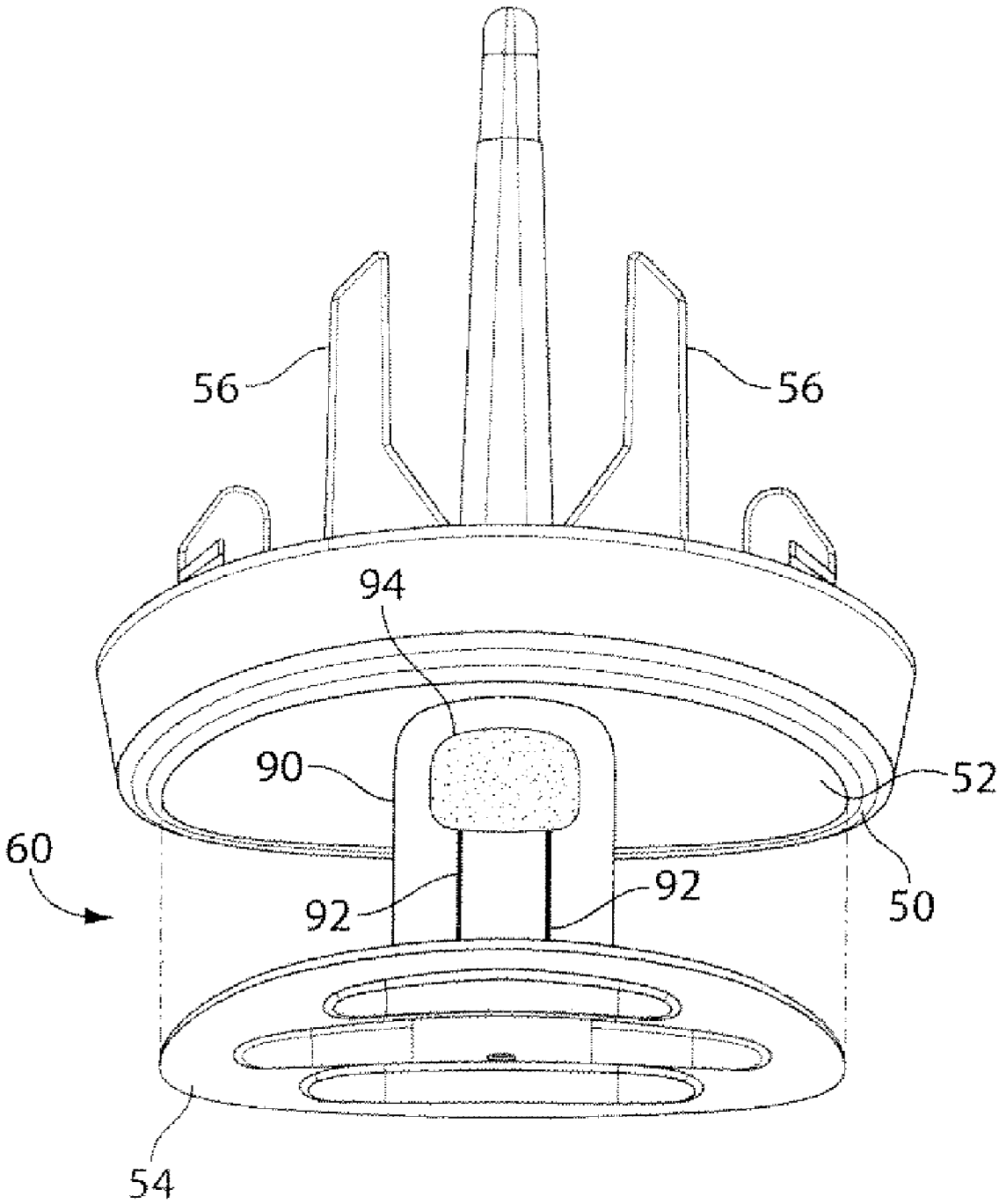
FIG. 6 is an exploded view of a button showing a sensor.

Referring to FIG. 6, in still other examples, sensor 60 may be disposed on the base member 52 of button 50, which may be formed of a relatively hard material, such as an acetyl polymer. In another embodiment, a gripping member 54 covers button 50. Gripping member can be made of any suitable material, e.g. relatively soft material, elastomer, hard material, or combinations thereof. Sensor 60 will sense the force applied to the gripping member 54 to overcome the rearwardly biasing force of spring 58 (FIG. 1A) and move the button 50 forward for cartridge release as well as possible additional forces when detaching cartridge 18 and bottoming out of the stroke of button 50.

In one example, sensor 60 may be a pressure sensitive resistor 90 electrically coupled to controller 40 by lines 92 that changes resistance in proportion to the force applied to active portion 94 disposed under the gripping portion 54. A suitable pressure sensitive resistor 90 is an Interlink FSR400 force sensitive resistor, available from Interlink Electronics, Inc., of Camarillo, Calif. In another example, sensor 60 may include a QTC resistive member and electrodes similar to those described above.

In other examples, the sensor may be of the type selected from conductive, capacitive, magnetic, resistive, proximity, pressure sensitive, chemical, inductive, electrical, mechanical, electromechanical, electromagnetic, and combinations thereof. Other sensors suitable for the intended purpose could likewise be used. In some examples, the sensor is convertible between a first level and second level in response to the action being applied. The sensor can be converted from the second level to the first level in response to the action being removed.

Cartridge Life Indication

New shaving cartridges have a finite quantity of expected life, use, or utility ("expected utility"), including, but not limited to, blade sharpness, lubrication, cleanliness, or other deteriorating qualities. Blades eventually dull and shaving performance deteriorates to a point at which a cartridge should be replaced. While the expected utility may vary from user to user for a number of reasons, assumptions may be made about the expected utility after which a cartridge should be replaced and consumer testing may provide data for maximizing expected utility across a broad range of users. Even if an individual user has a different expected utility than what is assumed, knowing the difference between the expected utility and that user's actual use (i.e., "remaining shaving utility") may guide the user in deciding when to replace a cartridge.

Figure 7:
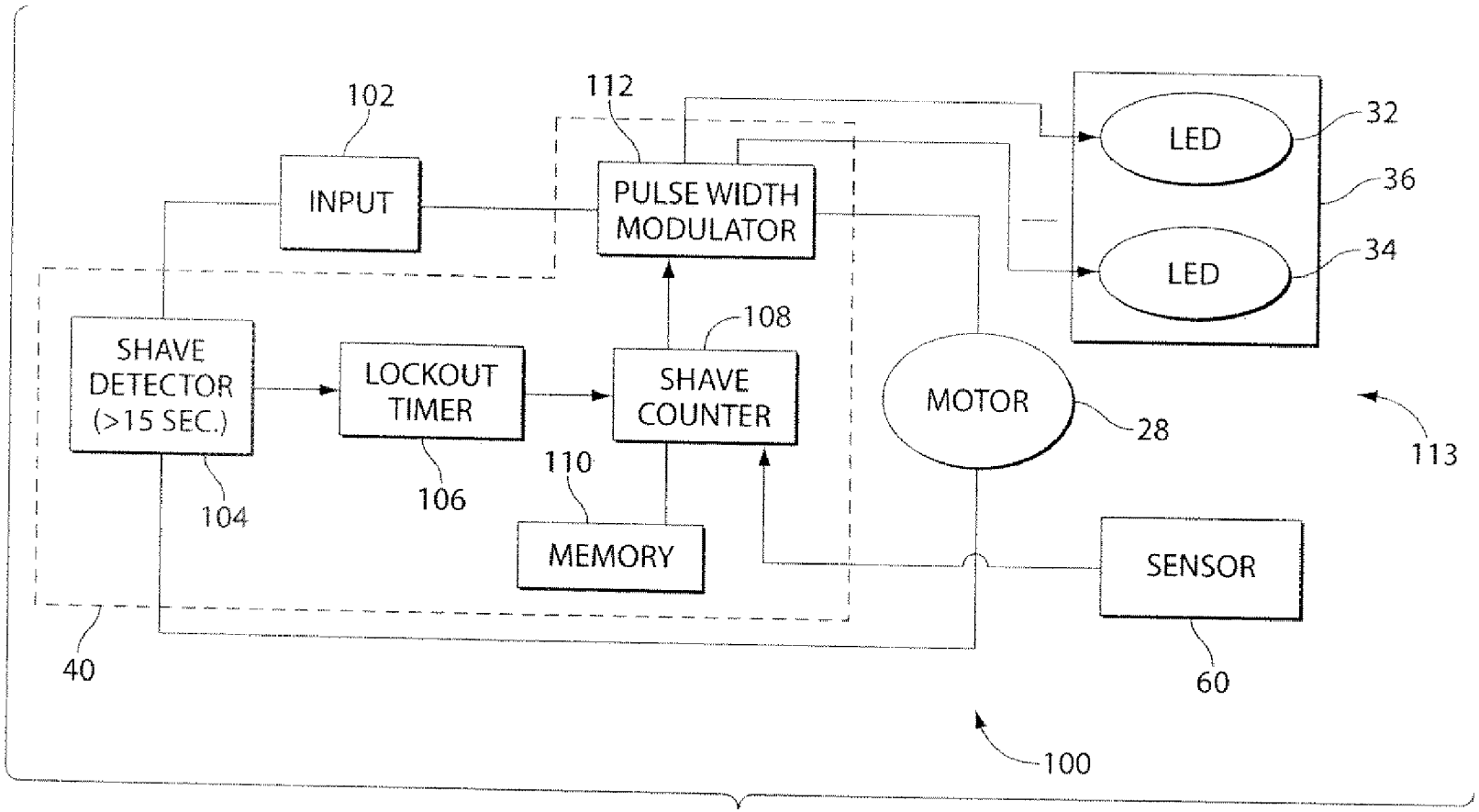
FIG. 7 shows a controller for determining and indicating a remaining shaving utility of a shaving cartridge.

Referring to FIG. 7, in some examples, razor 1 includes a cartridge life detection system 100 for tracking shaving utility of cartridge 18 and indicating remaining cartridge life. Controller 40 receives input from input source 102 when a user is shaving. In some examples, the input may be activating electrical device 28 by actuating switch 22. In other examples, the input could be the time that electrical device 28 is active. In still other examples, the input could be instances of time spent with contact between a user's skin and cartridge 18. One method of detecting skin contact is detailed in U.S. application Ser. No. 11/799,843. In still other examples, the input could be instances of or accumulated time of detected movement between the cartridge 18 and handle 10 or detected gripping of handle 10 by a user. In still other examples, one or more of the above inputs could be combined to determine when a user is shaving and cartridge 18 is being used.

Shave detector 104 determines whether the input from input source 102 should be counted and filters out inadvertent input. In one example, shave detector 104 times how long electrical device 28 remains active. After a period of time, such as 15 seconds, for example, it is likely that shaving is occurring and shave detector 104 allows the input from source 102 to be counted. In some examples, controller 40 includes a lockout timer 106 that counts down a period of time during which shaving input is not counted. For example, a user may momentarily switch off electrical device 28 during use or switch 22 may be inadvertently pressed while razor 1 is being stored between uses. Treating these inputs as separate and distinct "shaves" that reduce the remaining shaving utility of a cartridge would make system 100 less precise. In one example, lockout timer 106 disregards input from shave detector 104 for four hours after electrical device 28 is activated.

Shave counter 108 receives and tracks the shaving input received from shave detector 104, storing the accumulated shaving input (i.e., actual utility) in memory 110 while sensor 60 remains in a "cartridge attached" state. Shave counter 108 compares the tracked shaving input against an expected shaving utility, stored in memory 110, for example, and determines the remaining shaving utility of cartridge 18. In one example, counter 108 compares the number of electrical device 28 activations, filtered by shave detector 104 and lockout timer 106, as described above, and compares that to an expected number of activations. In some examples, the expected number of activations is greater than about 8, between about 8 and about 20, and about 14.

Controller 40 clears the accumulated shaving input from shave counter 108 and memory 110 when sensor 60 is in a "cartridge detached" state. In some examples, the cartridge detached state may be closing of a circuit, such as by closing microswitch 76 or reed switch 84 or by applying pressure to a resistive member 70 formed of QTC. In other examples, the cartridge detached state may be the opening of a circuit, such as by opening microswitch 76 or reed switch 84. In still other examples, the cartridge detached state may be a voltage across a resistive member 70 formed from a pressure sensitive polymer or across a pressure sensitive resistor 90 that exceeds a threshold value. In another example, the cartridge detached state may be achieved by continually depressing the power switch for at least 1 second.

Although the expected shaving utility may be programmed in controller 40 during manufacture, it need not be a fixed value. In some examples, system 100 could be configured to permit a user to adjust the expected shaving utility. In other examples, system 100 could automatically adjust the expected shaving utility based on a user's history of utility per cartridge. For example, shave counter 108 could remember the number of counted electrical device 28 activations for the prior five cartridges and adjust the expected shaving utility of the next cartridge to the average utility of the prior five.

Figure 8A:
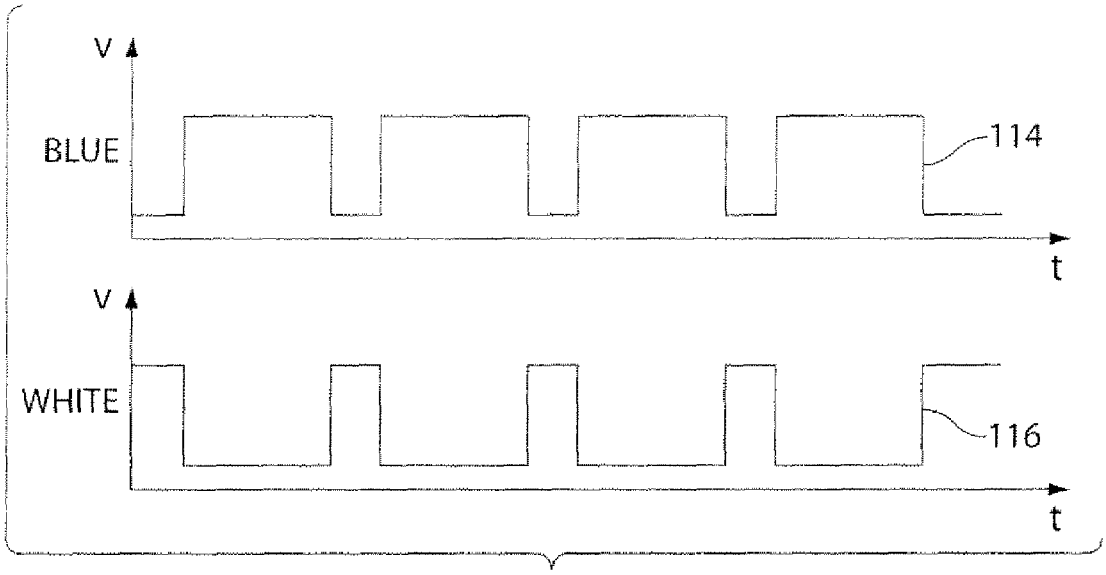
FIGS. 8A and 8B shows the signals output by components of a cartridge life indicator.
Figure 8B:
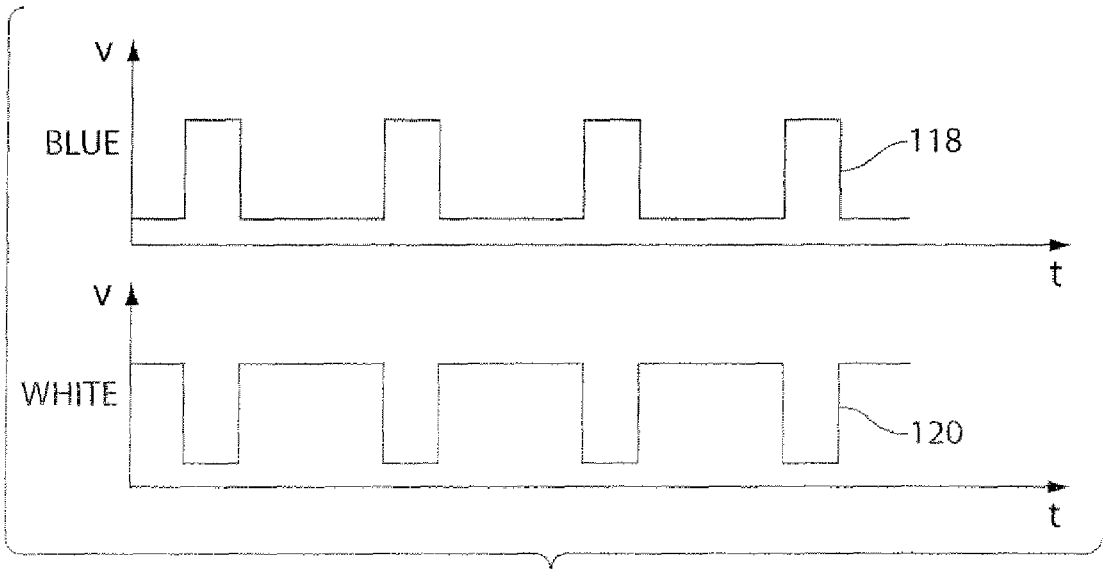

Referring to FIGS. 7, 8A, and 8B, in some examples, controller 40 indicates the remaining shaving utility of cartridge 18 with output light 113 emitted by LEDs 32 and 34 and mixed in light mixing member 36. Preferably, LEDs 32 and 34 emit contrasting colored lights, such as blue and white, for example. Pulse width modulator generates signals 114 and 116 to illuminate LEDs 32 and 34, respectively, at low and high voltage levels. When the signal pulses (i.e., higher voltage) are relatively long compared to the time between pulses (i.e., lower voltage), such as signal 114, the LED emits a relatively bright light. Conversely, when the pulses are relatively short compared to the time therebetween (e.g., signal 116), the LED emits a relatively dim light.

By mixing two lights of contrasting color and variable brightness, system 100 is able to communicate a wide and gradual range of colored output light 113 representing remaining cartridge life to a user with few light elements and low power consumption. In some examples, the color of LED 32 represents remaining shaving utility, with the full brightness representing full remaining shaving utility (i.e., expected utility). The color of LED 34 represents the absence of remaining shaving utility, with the full brightness representing no remaining shaving utility and that the cartridge should be replaced. For example, sending signal 114 to a blue LED 32 (i.e., producing a bright blue light) and signal 116 to a white LED 34 (i.e., producing a pale white light) results in color mixing member 36 emitting a relatively deep blue output light 113, indicating more remaining shaving utility. Sending signal 118 to a blue LED 32 (i.e., producing a pale blue light) and signal 120 to a white LED 34 (i.e., producing a bright while light) results in member 36 emitting a relatively pale blue output light 113, indicating less remaining shaving utility. The two lights may be mixed so that output light 113 maintains steady brightness or varies in brightness over the range of colored light output. The two lights may be changed proportionally to the remaining shaving utility or non-proportionally (e.g., exponentially). Each light may be changed dependently or independently of the other. In other examples, light sources other than LEDs could be used. In still other examples, more than two light sources could be used. Additive light mixing of three primary colors could be used to generate the entire range of visible colors, for example.

Figure 9:
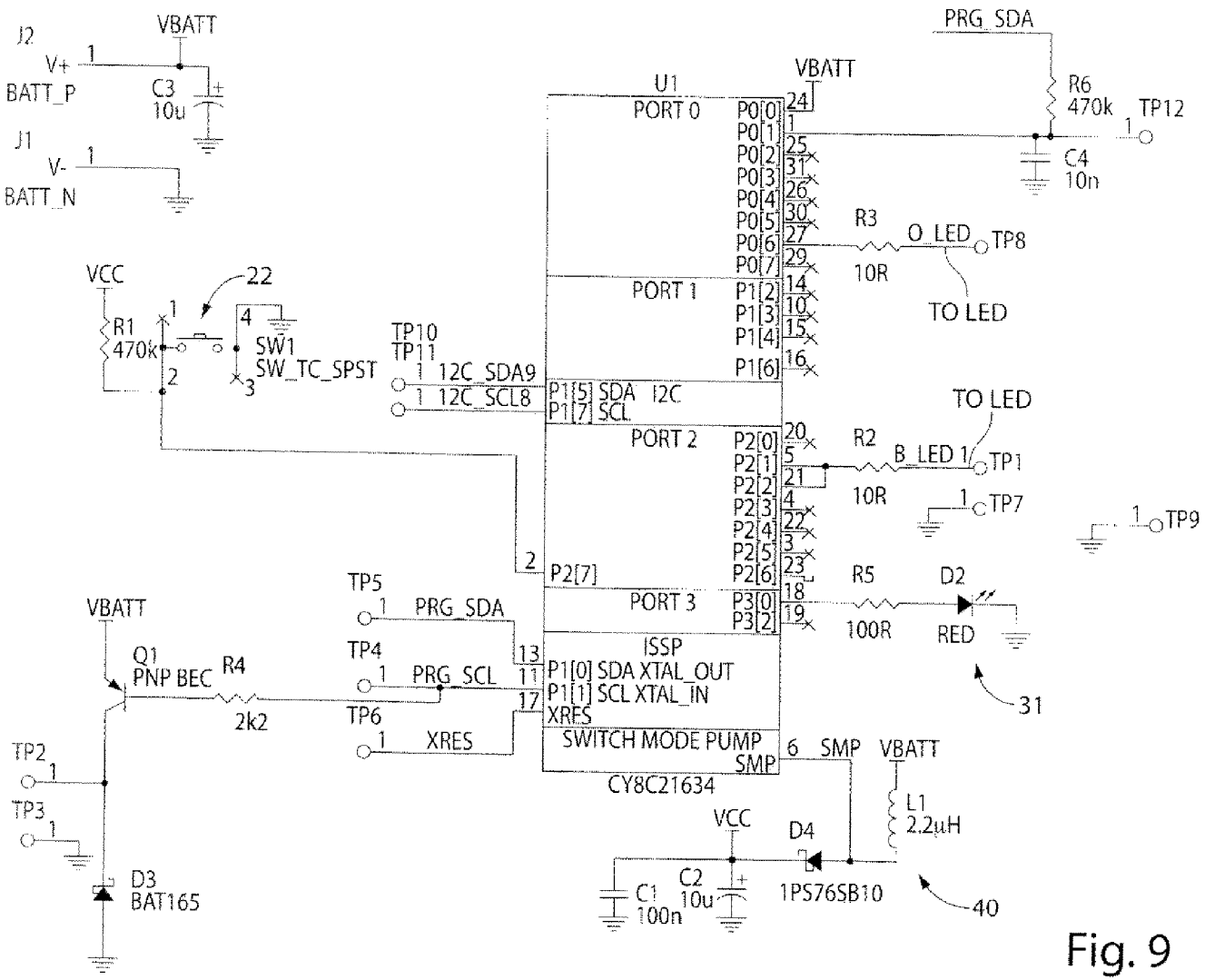
FIG. 9 shows an embodiment of the controller of FIG. 6.

Referring to FIG. 9, a configuration of controller 40 may be implemented in a programmable-system-on-chip, such as CY8C21634, available from Cypress Semiconductor Corp., of San Jose, Calif. Controller 40 includes a microcontroller U1. The integrated switched mode pump (SMP) in conjunction with L1, D4 and C2 boosts a 1.4V alkaline battery coupled by VBATT to 3.3V (VCC). Razor 1 is turned on by switch 22 (SW1) which has a weak pull up resistor R1. Microcontroller U1 detects the activation of switch 22 through a General Purpose Input Output (GPIO). Microcontroller U1 turns electrical device 28 on and off though transistor Q1. D3 is used to protect controller 40 from back EMF from electrical device 28. Microcontroller U1 directly powers the LEDs 32 and 34 through small current limiting resistors R2 and R3. As discussed above, controller 40 controls the brightness of the LEDs 32 and 34 through Pulse Width Modulation (PWM). The output for the LED 32 (pin P2[1]) is also fed back into the microcontroller U1 to create the inverse PWM for the LED 34 output (pin P0[6]). A low battery indicator light 31 is provided by the red LED (D2) and its current limiting resistor R5. Microcontroller U1 can detect the removal of cartridge 18 through cartridge detachment sensor 60 using the potential divider formed by R6. The microcontroller U1 monitors this activity using another GPIO (pin P0[1]). Capacitor C4 provides filtering on the signal from cartridge detachment sensor 60. Of course, controller 40 could be implemented in other ways, such as by using discrete components (e.g., transistors, diodes, resistors, and capacitors) or customized ASIC configured for the functionality described herein.

Figure 10:
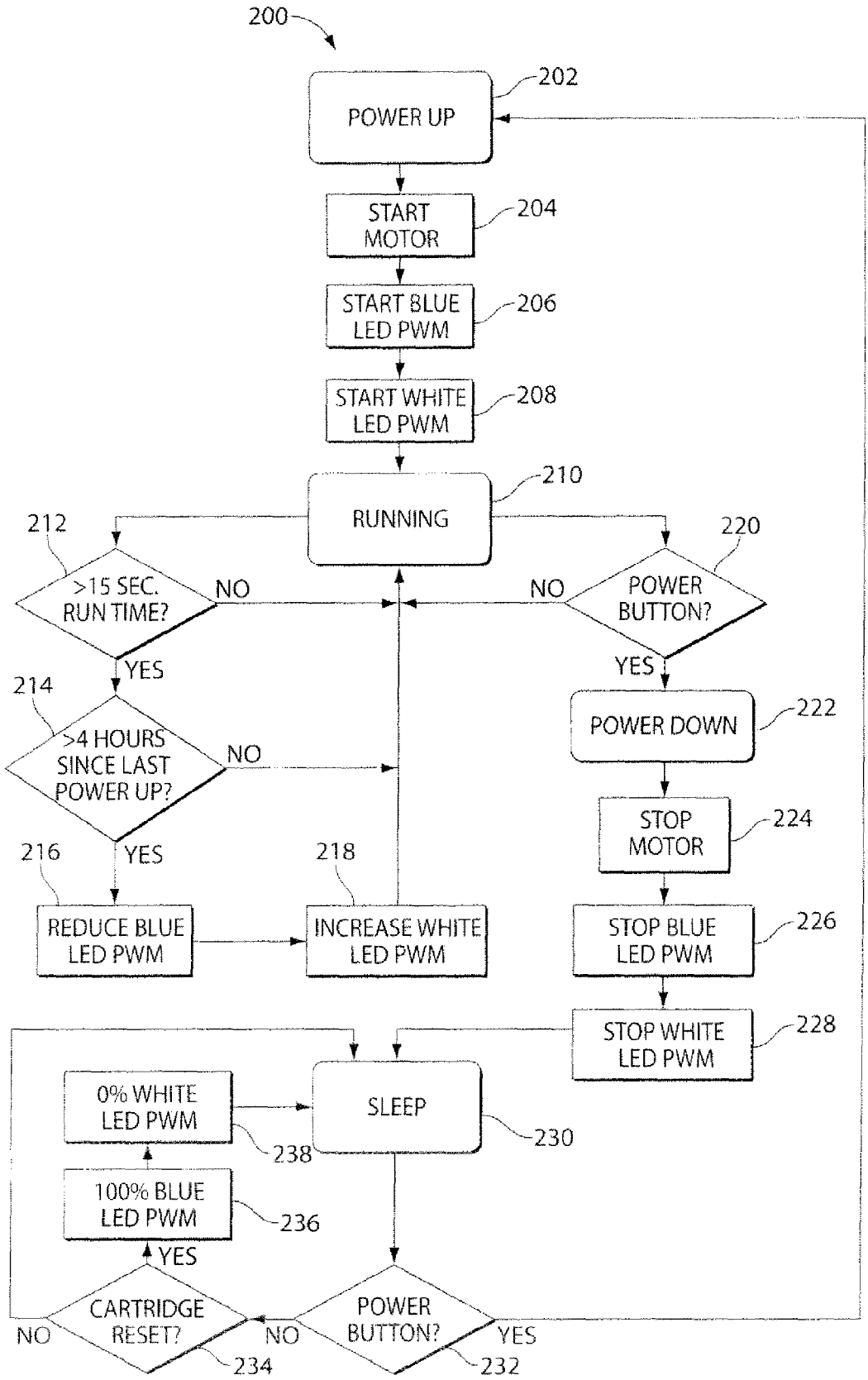
FIG. 10 shows a method of determining remaining shaving utility of a cartridge and indicating the remaining shaving utility to a user.

Referring to FIG. 10, in some examples a method 200 of controlling razor 1 begins with razor 1 being powered up at step 202 when a user presses switch 22. Electrical device 28, e.g. motor, starts at step 204 and pulse width modulation of a blue LED 32 and a white LED 34 begins (206, 208) to bring razor 1 into "running" mode at step 210. If razor 1 is in running mode for more than 15 seconds (212) and more than four hours have passes since the last razor power up (214) then razor 1 has accumulated a shaving utility. Accordingly, pulse widths to blue LED 32 are incrementally decreased, slightly dimming LED 32 (216) and pulse widths to white LED 34 are incrementally increased (218), slightly brightening LED 34. This results in a slight fading of blue colored output light 113 emitted by light mixing member 36. As more shaving utilities are accumulated, output light 113 eventually becomes entirely white, at which time cartridge 18 should be replaced.

While in running mode, if switch 22 is actuated at step 220, razor 1 enters power down mode at step 222, in which the motor (224) and LEDs 32 and 34 (226, 228) are stopped, and then enters sleep mode at step 230. While in sleep mode, switch 22 and sensor 60 are monitored (232, 234). If cartridge 18 is detached, pulse width modulation for blue LED 32 is set to 100% at step 236 and modulation for white LED 34 is set to 0% modulation at step 238. If switch 22 is actuated during sleep mode at step 232, razor 1 re-enters power up mode at step 202.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A safety razor comprising:

a handle and a cartridge selectively detachable from the handle, the cartridge comprising at least one blade with a sharp cutting edge and an expected shaving utility;

a cartridge release mechanism arranged to move in a first direction coupled to the handle and configured to detach the cartridge from the handle in response to an action performed by a user; and a sensor within the razor comprising a pin member projecting from the cartridge release mechanism, the pin member momentarily interacts with a resistive member only during detachment of the cartridge from the handle the resistive member configured to generate a signal in response to the momentary interaction of the pin with the resistive member, the resistive member comprising a polymer having particles of metal or semi-conducting material dispersed therein wherein the resistive member has a first level of conductance when quiescent convertible to a second level of conductance in response to the action applied by the cartridge release mechanism.

2. The safety razor of claim 1 wherein the sensor further comprises first and second electrodes each electrically coupled to the resistive member.

3. The safety razor of claim 2, wherein the resistive member is configured to electrically couple the first and second electrodes when having the second level of conductance and to electrically uncouple the first and second electrodes when having the first level of conductance.

4. The safety razor of claim 1, wherein the sensor comprises a pressure sensitive resistor configured to generate the signal in proportion to a pressure applied by the actuator.

5. The safety razor of claim 1, further comprising an electrical arrangement for detecting and tracking utility of the razor and determining a remaining shaving utility of the cartridge based on an expected utility and a tracked utility, wherein the electrical arrangement is configured to receive the signal and reset the tracked utility when the signal exceeds a threshold value.

6. The safety razor of claim 1, wherein the connecting structure comprises a button and the action includes pushing the button through a detachment stroke.

7. The safety razor of claim 1 further comprising an electrical arrangement for detecting and tracking utility of the razor, determining a remaining shaving utility based on the beginning shaving utility and the tracked utility, and resetting the tracked utility in response to the signal, the electrical arrangement comprising an input source.

8. The safety razor of claim 7, wherein the input source is configured to detect user activation of the electrical arrangement.

9. The razor of claim 7 wherein resetting the tracked utility in response to the signal is by attaching the cartridge to the connecting structure.

10. The razor of claim 7 wherein resetting the tracked utility in response to the signal is by detaching the cartridge from the connecting structure.

11. The razor of claim 7 wherein the electrical arrangement is configured to track a number of pivotal displacements from a rest position.

12. The razor of claim 7 wherein the electrical arrangement is configured to track an accumulating time period of pivotal displacement from a rest position.

13. The razor of claim 7 wherein the electrical arrangement is configured to detect pivotal displacement of the cartridge from a rest position.

14. The razor of claim 7 wherein the electrical arrangement is configured to detect a force acting on the razor.

15. The razor of claim 7 wherein the electrical arrangement is configured to track a number of activations of the input source.

* * * * *